United States Patent [19]

Söthje

[11] 4,157,887

[45] Jun. 12, 1979

[54] PRESSING DIE FOR PRODUCING CERAMIC MOULDS FROM A PULVERULENT MASS

[75] Inventor: Günther Söthje, Selb, Fed. Rep. of Germany

[73] Assignee: Gebruder Netzsch, Maschinenfabrik GmbH & Co., Selb, Fed. Rep. of Germany

[21] Appl. No.: 881,088

[22] Filed: Feb. 24, 1978

[30] Foreign Application Priority Data

Jun. 24, 1977 [DE] Fed. Rep. of Germany ..... 2728630

[51] Int. Cl.[2] ..... B30B 5/02; B28B 3/02; B28B 7/08; B28B 7/10

[52] U.S. Cl. ..... 425/405 H; 425/412; 425/415; 425/422; 425/423; 425/DIG. 19

[58] Field of Search ..... 425/405 R, 405 H, 412, 425/415, 419, 422, 423, DIG. 19, 346, 351

[56] References Cited

U.S. PATENT DOCUMENTS

| | | | |
|---|---|---|---|
| 1,712,233 | 5/1929 | Slick | 425/419 X |
| 2,152,738 | 4/1939 | Jeffery | 425/405 H X |
| 2,290,910 | 7/1942 | Jeffery | 425/405 H X |
| 3,239,591 | 3/1966 | Wendt | 425/405 H X |
| 3,425,363 | 2/1969 | Carbon | 425/422 X |
| 3,587,144 | 6/1971 | Mechling | 425/422 |
| 3,632,276 | 1/1972 | Memk | 425/415 |
| 3,664,799 | 5/1972 | Wallick, Jr. et al. | 425/405 H X |

FOREIGN PATENT DOCUMENTS

| | | | |
|---|---|---|---|
| 1808144 | 6/1970 | Fed. Rep. of Germany | 425/405 H |
| 2637231 | 2/1978 | Fed. Rep. of Germany | 425/405 H |

*Primary Examiner*—J. Howard Flint, Jr.
*Attorney, Agent, or Firm*—Karl W. Flocks

[57] ABSTRACT

A press tool for production of moulded ceramic articles from powder material includes a lower tool part adapted to be supported on a press table and carrying a lower die. A matrix shell encircles the lower die and is mounted to move up and down relatively to it. An upper tool part is adapted to be connected to the plunger of the press and carries an upper die which on lowering of the plunger of the press projects into the matrix shell. To fill the powder material into the cavity defined by the lower die and the matrix shell, an annular hopper in the form of an funnel encircles the upper die and is mounted to slide axially thereon. The hopper has an annular outlet facing radially inwards and opening into the cavity when the hopper is in its lower position with respect to the upper die but closed by the upper die when the hopper is in a raised position relatively to the upper die.

14 Claims, 7 Drawing Figures

PRESSING DIE FOR PRODUCING CERAMIC MOULDS FROM A PULVERULENT MASS

The present invention relates to press tools for production of moulded ceramic articles, such as plates, from powder material, of the type including a lower tool part adapted to be supported on a press table and carrying a lower die, a matrix shell encircling the lower die and mounted to move up and down relatively to it, and an upper tool part adapted to be connected to the plunger of the press and carrying an upper die which on lowering of the plunger of the press projects into the matrix shell.

For decades many attempts have been made to press powder material to form plates and similarly rounded ceramic moulded articles for which the thickness varies considerably along the diameter, in such a way that there is no distortion during the subsequent firing.

Previous experience has shown that among the known methods for pressing a ceramic material into moulded articles with curved surfaces the method, known from the DT-OS No. 21 55 571, is most suitable for obtaining a relatively uniform compression. This process uses a press tool of the type referred to above in which the mould cavity is larger than the volume of powdery material required for producing the desired moulded article, and the volume is reduced before pressing by moving the lower die upwards relatively to the matrix shell, so that part of the material flows out forming a heap above the inner edge of the matrix shell. However, the contour of this heap can correspond sufficiently accurately to the contour of the top-half mould, only if this contour is fairly smooth and nowhere is steeper than the angle of repose of the material.

An object of the present invention is to provide a press tool of the type described enabling a complete, homogeneous filling of the cavity to be obtained in such a way that the shape of the filling closely matches the shape of the moulded article to be produced, and at the same time to improve the uniformity of compression obtainable for various parts of the moulded article during pressing.

According to the present invention, to fill the powder material into the cavity defined by the lower die and the matrix shell, a press tool of the type specified includes an annular hopper in the form of a funnel encircling and mounted to slide axially on the upper die, the hopper having an annular outlet facing radially inwards and opening into the cavity when the hopper is in a lower position with respect to the upper die but closed by the upper die when the hopper is in a raised position relatively to the upper die.

In this way it has become possible to form a cavity between the upper and lower dies which is bounded on its radially outer side by the annular hopper when this is lowered with respect to the upper die, and is connected to the interior of the annular hopper so that a sufficient quantity of powdery material can flow from the annular hopper to fill the cavity. By a subsequent common upward movement of the annular hopper and the matrix shell with respect to the upper die the cavity is separated from the interior of the annular hopper and at the same time or immediately thereafter it is also closed to the outside by the matrix shell. For press tools according to the invention for production of plates and similar flat ceramic moulded articles the differences in density between the upper and lower parts of the cavity are negligible; in every case the density distribution before pressing is rotationally symmetrical.

Preferably a cylindrical collar with a diameter slightly larger than the inside diameter of the matrix shell is formed on the upper die for guidance and closing of the annular hopper. This ensures that sufficient ceramic material is also available at the edge of the moulded article.

To obtain a similar effect the matrix shell may have a funnel-shaped chamfer corresponding to the similarly funnel-shaped lower end of the annular hopper. When the annular hopper is moving upwards, a small supply of powdery material is deposited on the funnel-shaped chamfer of the matrix shell from where it can subsequently, if necessary, flow into the cavity, before the upper die enters the matrix shell.

The measures described are sufficient for uniform filling of the cavity, provided that the lower die and the upper die are concave or convex respectively from the edge to the central region, i.e. do not have too large flat areas. Preferably for production of special flat, moulded articles, for example large plates, the annular hopper, together with the lower die, matrix shell and upper die, can be tilted about a tilting axis extending transversely to the axis of the mould. Even for difficult shapes a brief single tilting through 90° during the process of filling is generally sufficient also to fill flat horizontal parts of the filling volume so that, on tilting back to the vertical position of the axis of the mould, completely uniform filling is obtained.

The construction of the pressing tool is particularly simple and space saving when the tilting axis and mould axis intersect at right angles to each other. If, however, the tilting axis and the mould axis are not in the same plane and the distance between them is sufficiently large, then a further advantage is obtained in that the press tool according to the invention in its tilted position can be completely removed from the space between the press table and plunger of the press, and thus a second press tool of the same shape can be moved into the cleared space. Consequently two of the press tools according to the invention can be alternately filled with powder material and used with the same press.

Advantageously the tilting axis is defined by trunnions on a frame in which the lower and upper parts of the tool are guided to move relatively to one another in the direction of the axis of the mould, the lower part of the tool being supported by springs.

The uniformity of compression, obtained by pressing by means of a press tool of the type specified for production of plates, dishes and the like from powder material, can be improved if the lower die is formed in three coaxial rings.

Thus according to a further aspect of the invention in a press tool of the type specified above, the lower die includes a radially outer mould ring with a contour corresponding at least to the radially outer part of the underside of the rim of the plate and also an intermediate mould ring corresponding to the foot of the plate and, if required to the radially inner part of the rim of the plate, the intermediate mould ring being adjustable relatively to the outer mould ring along the axis of the mould, and a radially inner mould plate which corresponds to the base of the plate and is rigidly connected to the outer mould ring.

This design of the press tool permits independent variation of the height of the cavity on the one hand in the region of the rim and the base of the plate, and on the other hand also in the region of the foot of the plate, and enables these heights to be adjusted so that the desired compression is obtained for all regions of the completed moulded article, and thus the advantageous effect of homogeneous filling is fully exploited.

For this purpose the outer moulding ring may be part of, or may be supported by the lower part of the tool, into which a threaded stop ring is screwed, to serve as adjustable support for the intermediate mould ring, with a plug extending downwards from the central mould ring through the threaded stop ring for operation by a lifting mechanism of the press.

Furthermore, it is advantageous if the lower part of the tool is supported on the frame of the tool by means of springs which in the unloaded condition hold it at a distance above the press table. This provides a possibility of pre-compressing the ceramic material at the beginning of each cycle of pressing.

As an alternative to the three part design of the lower die described above another form of the invention was particularly successful in which a membrane, clamped at its outer edge, closes a chamber for a pressurizing agent in the lower die, the greater part of the area of the membrane, in the state for filling, being held against the lower die. This has the advantage that an exactly defined cavity volume in which the ceramic material can distribute itself completely uniformly is available for the ceramic material to suit the dimensions of the pressed moulded article in a desired way. When the upper and lower dies are closing up, the membrane does not change its shape and position, or at least not significantly because at the outset, at least a large part of it is touching the rigid lower die. Consequently there are no significant relative movements between the powdered ceramic material and the membrane whilst the upper and lower dies are closing up. During or preferably after closing up of the upper and lower dies the chamber for the pressurising agent may be pressurized in a known way to produce a uniform after-compression of the moulded article.

In the state for filling, the membrane may be held against the lower die by its own elasticity as long as the pressure in the chamber for the pressurizing agent is the same as the ambient pressure. This presupposes that the relaxed shape of the membrane essentially corresponds to that of the lower die.

In a modified arrangement the membrane by itself—i.e. in a relaxed condition—is essentially flat but in the state for filling it is held against the lower die by suction in the chamber for pressurizing agent.

Further features and details of the invention will be apparent from the following description of two specific embodiments, which will be given by way of example with reference to the accompanying drawings, in which FIG. 1 is a front view, partially in section, of parts of a press with the press tool according to the invention installed and at rest;

Figure 1:
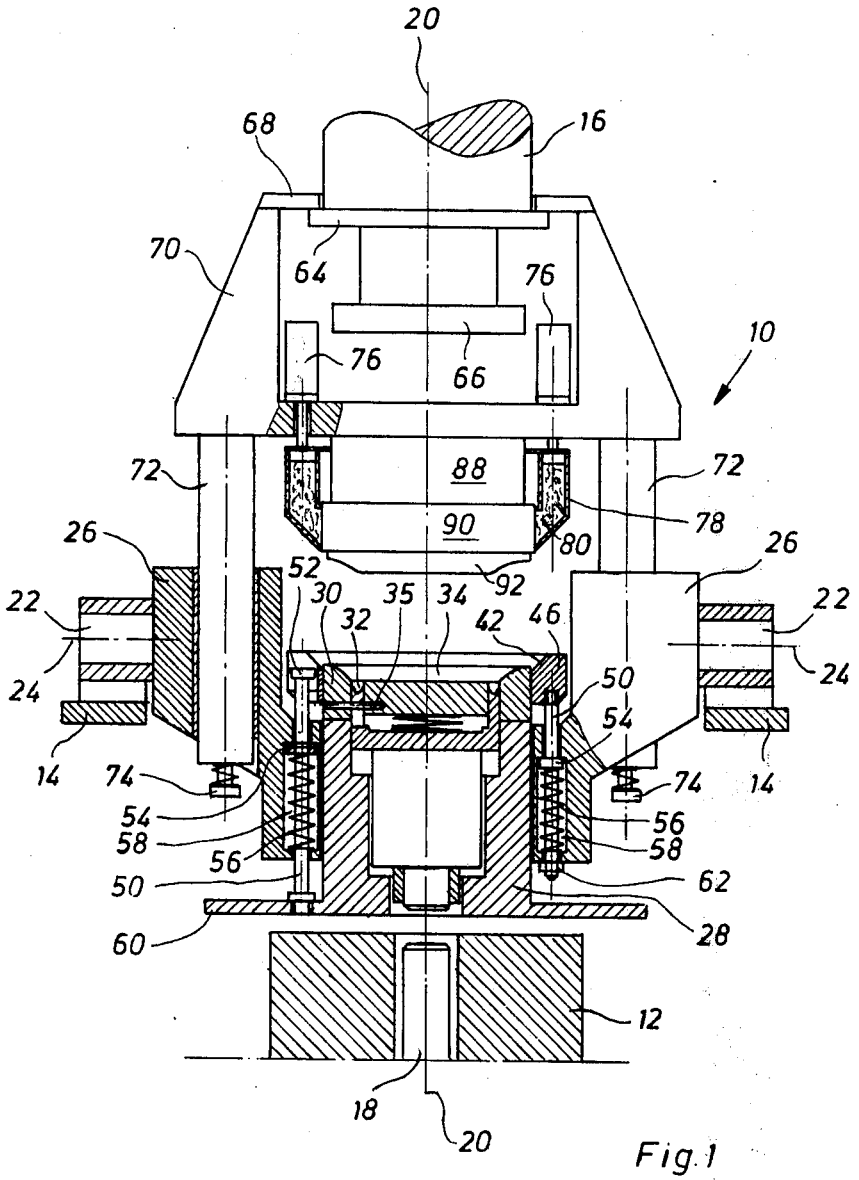

The press tool 10 shown, is installed in a commercial hydraulic or mechanical press of which a press table 12, two bearing blocks 14 above and to the side of the table, and a plunger 16 arranged vertically above the press table, are shown. Below the press table 12 the press includes a lifting mechanism of which only a bolt 18 which can move upwards through the press table can be seen. The vertical axis along which parts of the press tool 10 the plunger 16 of the press and the lifting mechanism 18 can move, will be referred to below as the axis 20 of the mould.

Figure 2:
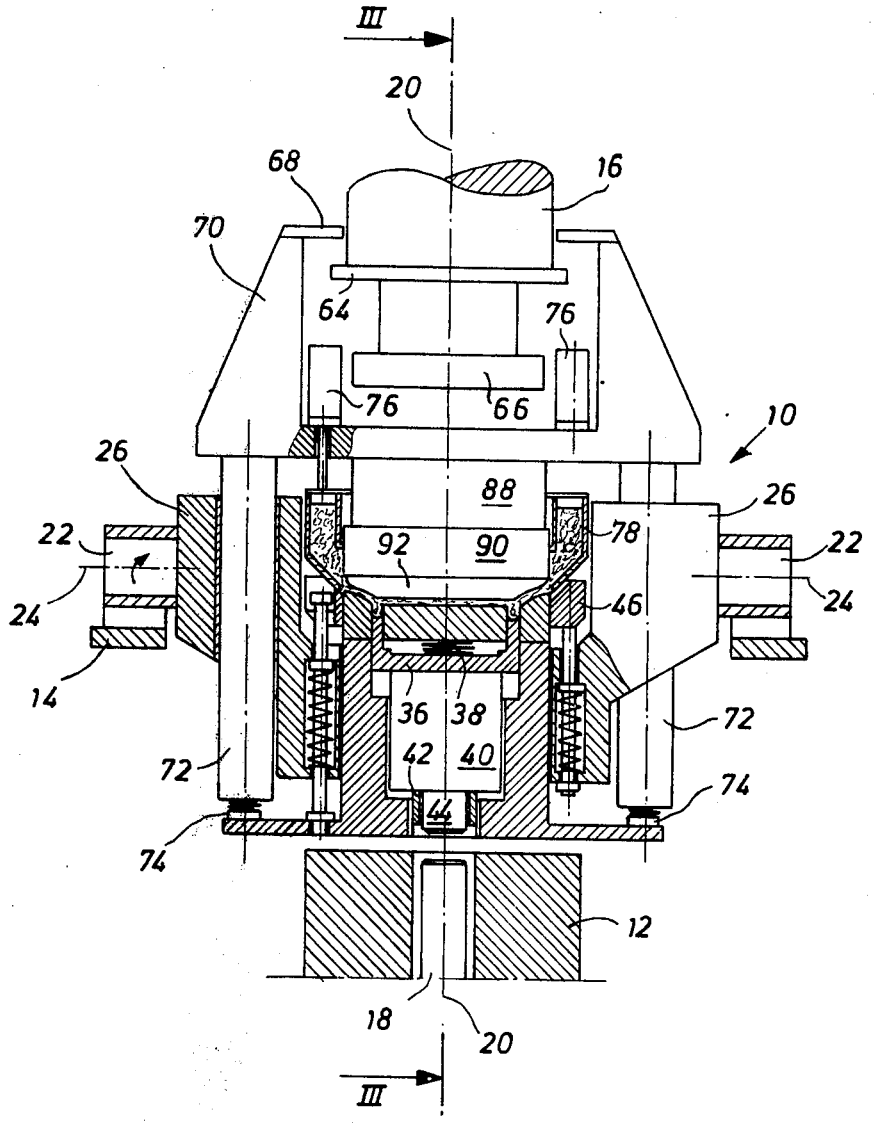
FIG. 2 is a corresponding view for the first phase of the process of filling.
Figure 3:
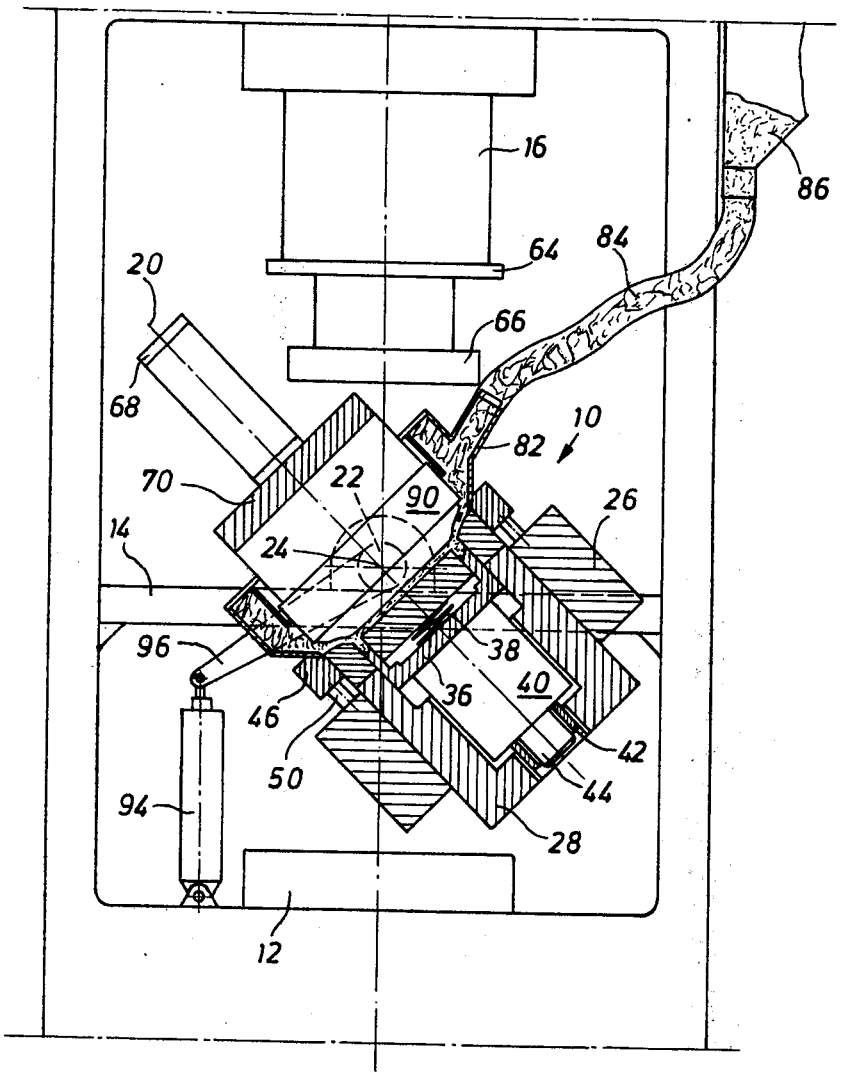
FIG. 3 is a side view, partially in section on the line III—III of FIG. 2, showing the press and the press tool during a second phase of the filling process.
Figure 5:
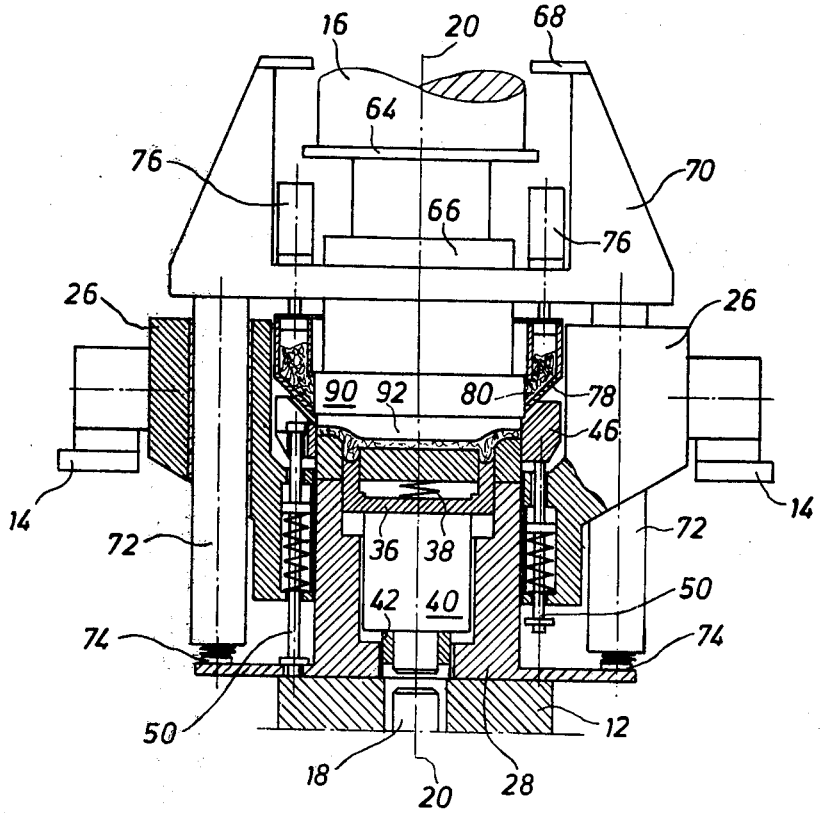
FIG. 5 is a corresponding detail during the process of filling.

A horizontal tilting axis 24 is defined by the two bearing blocks 14 together with trunnions 22 pivoted on them, and in the example shown it intersects the axis of the mould, but it could also be arranged to be at a distance from the axis of the mould and outside the press. The two trunnions 22 are part of a tool frame 26 which surrounds the lower tool part 28 and guides it along the axis 20 of the mould. The lower tool part 28, in its position of rest as shown in FIG. 1 and also during the process of filling as shown in FIGS. 2 and 3 is spaced from the press table 12, but it can be supported on the press table as shown in FIG. 5. A lower die 29, supported by the lower part of the tool, includes three parts, namely a radially outer mould ring 30, an intermediate mould ring 32 and a radially inner mould plate 34.

Figure 6:
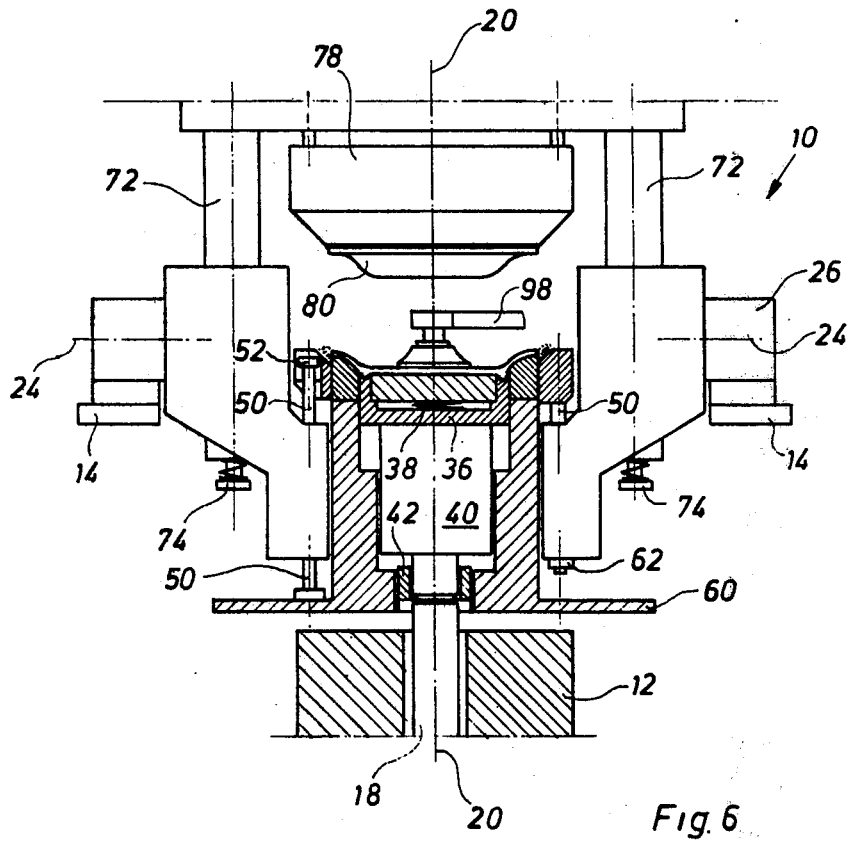
FIG. 6 is a corresponding detail after pressing with a pressed plate being removed.

The upper face of the outer mould ring 30 is complementary to the rim of the plates T (FIG. 6) which are to be produced with the press tool. The upper face of the intermediate mould ring 32 is complementary to the foot of the plate, and the upper face of the inner mould plate 34 is complementary to the base of the plate, i.e. essentially flat. The outer mould ring 30 and the inner mould plate 34 are rigidly connected to each other—for example by radial bolts 35—and are a replaceable fixture on the lower tool part 28. The intermediate mould ring 32 is the upper edge of a pot shaped insert 36 carried by a cylindrical body 40 which can be moved along the axis 20 of the mould and is guided in the lower tool part 28. A compression spring 38 urges the intermediate mould ring 32 away from the inner mould plate 34, so that it tends to move down to its position of rest as shown in FIG. 1, where the bottom of the body 40 rests on a threaded stop ring 42. The threaded ring 42 is screwed into the lower tool part 28 and can be adjusted along the axis 20 of the mould. The body 40 has a plug 44 which extends downwards through the threaded ring 42 and, as shown in FIG. 6, it can be engaged by the lifting mechanism 18.

An annular matrix shell 46 with a funnel-shaped chamfer 48 on its upper side is guided by the cylindrical outer surface of the outer mould ring 30. Three long rods 50 which are spaced 120° about the axis and of which only one is seen on the left in the drawings extend parallel to the axis 20 of the mould through the matrix shell 46. Each of the long rods 50 has a head 52, by means of which the matrix shell 46 can be pulled downwards, and a collar 54 urged upwards by a compression spring 56 in a recess 58 in the tool frame 26. The lower end of each of the long rods 50 is screwed into a base plate 60 of the lower tool part 28.

Three short rods 50' which are also arranged parallel to the axis 20 of the mould are each displaced by 60° between the long rods 50. The upper ends of each is screwed into the matrix shell 46, and each of them has a collar 54' which is acted upon by a compression spring 56' in a recess 58' of the tool frame 26. Below the tool frame 26 an adjustable nut 62 is screwed on to each of the short rods 50'.

The plunger of the press 16 has a collar 64 and at a distance below it a thrust plate 66. A yoke 68 which impart of the upper tool part 70 rests on the collar 64. The upper tool part 70 has two guide rods 72 which are parallel to the axis 20 of the mould and are adjustably guided in the tool frame 26. Each column has a spring loaded foot 74, with an adjustment for the spring, which can rest on the base plate and support the guide rods.

An annular hopper 78 is suspended from the upper tool part 70 through an actuating mechanism 76, consisting of three pneumatic piston-cylinder units which are spaced at 120° apart round the axis. The lower part of the annular hopper 78 is tapered in the form of a funnel and at the same angle as the funnel-shaped chamfer 48 of the matrix shell 46 which is arranged coaxially below the annular hopper. The annular hopper 78 is completely closed except for an annular outlet 80 facing radially inwards from its lower region and except for a union 82 which is connected by means of a tube 84 to a storage bunker 86 for ceramic powder material as shown in FIG. 3.

Radially inside the hopper 78 and concentrically to the axis 20 of the mould there is an upper die 88 which is fixed to the upper tool part 70. The upper die 88 has a cylindrical collar 90, controlling the annular outlet 80 of the annular hopper 78. An upper mould face 92, complementary to the upper side of the plate to be moulded is part of, or is fastened to the underside of the upper die 88.

For tilting of the whole press tool 10 around the tilting axis 24 there is a pneumatic piston-cylinder unit 94 as shown in FIG. 3 which has one end connected to the press and the other end to a lever 96 which in turn is fixed to the tool frame 26 and provides a flexible connection.

To remove pressed plates there may be an automatic removal mechanism 98 which may have a swivel arm with a suction cup as shown in FIG. 6.

The operation is as follows:

In its position of rest as shown in FIG. 1, the upper tool part 70 is suspended by its yoke 68 on the collar 64 of the plunger 16 of the press. The lower tool part 28 is hanging on the long rods 50 at a distance above the press table 12, and the long rods are supported by the compression springs 56 acting on their collars 54, and the tool frame 26. The position of the central mould ring 32 within the lower tool part 28 depends on the adjustment of the threaded stop ring 42. The matrix shell 46 is arrested in its upper extreme position by means of the short rods 50' and the compression springs 56' which support the rods.

For filling the mould the plunger 16 of the press is lowered so far that the upper tool part 70 is supported on the feet 74 of its guiding columns 72 resting on the base plate 60 of the lower tool part 28 as shown in FIG. 2. In this process the lower tool part 28 does not change its position because the springs 56 are pre-compressed more than necessary to carry the weight of the lower tool part 28 and the upper tool part 70. Due to the downward movement of the upper tool part 70 the upper mould face 92 approaches the lower mould face which consists of the moulding rings 30 and 32 and the mould plate 34. Between the lower and upper mould faces a cavity is enclosed which radially outwards extends into the interior of the annular hopper 78, when the annular hopper has been lowered by means of the actuating mechanism 76 as shown in FIG. 2. Now some of the powder material, contained in the annular hopper 78, flows into the cavity, and this is facilitated by tilting the whole press tool through an angle of, for example, 30° to 45° and if necessary, through 90° as shown in FIG. 3. When the press tool 10 has been tilted back to its normal position, the cavity is completely filled.

Figure 4:
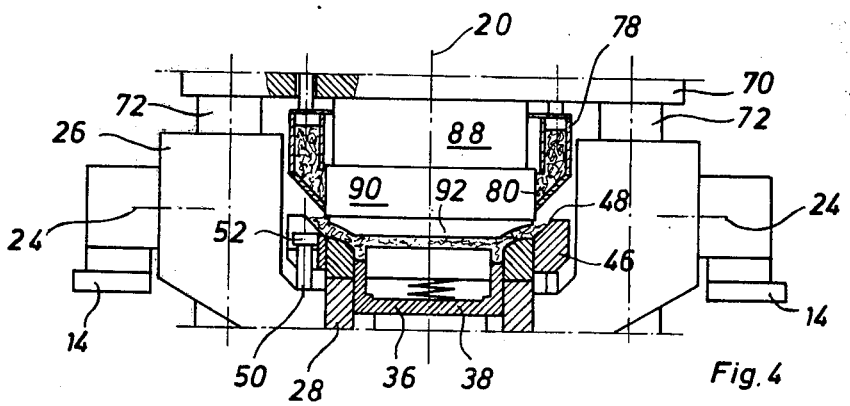
FIG. 4 is a detail corresponding to the views of FIG. 1 and 2 immediately after completion of the process of filling.

Now the annular hopper 78 is again raised to its starting position in relation to the upper die 88 by means of the actuating mechanism 76, so that the cylindrical collar 90 of the upper die closes the outlet 80 of the annular hopper. During the upward movement of the annular hopper 78 some of the powdery material has been left behind on the funnel-shaped chamfer 48 of the matrix shell 46 as shown in FIG. 4, so that the outer region of the cavity remains reliably filled. Subsequently, the plunger 16 of the press is further lowered as shown in FIG. 5 so that its thrust plate 66 presses on the upper tool part 70 therefore the whole upper tool part 70 including the upper die 88 and annular hopper 78, is moving downwards. The pre-compression of the springs 56 which can be adjusted in the same way as that of the springs 56' and the force of the spring 38 is overcome by the force which is transmitted from the spring loaded feet 74 to the base plate 60. Therefore the lower tool part 28 moves downwards. At the beginning of the downward movement of the upper die 88 the matrix shell 46 begins to close the outer periphery of the cavity as the upper mould face 92 enters the matrix shell.

Eventually there is a position in which the base plate 60 of the lower tool part 28 rests on the press table 12 as shown in FIG. 5. In this position further compression can be effected by an upward pressure from the lifting mechanism 18, acting through the plug 44 and cylindrical body 40 on the cup shaped insert 36 so that the intermediate mould ring 32 moves upwards by the same distance as the cylindrical body 40. In this way sufficient compression is obtained for the foot of the plate which is difficult to make. For a plate for which also a region extending radially outwards from the foot of the plate is difficult to make, for example because this region is ascending steeply, the intermediate mould ring 33 may be made wider, so that it also provides extra compression for this difficult region.

Figure 7:
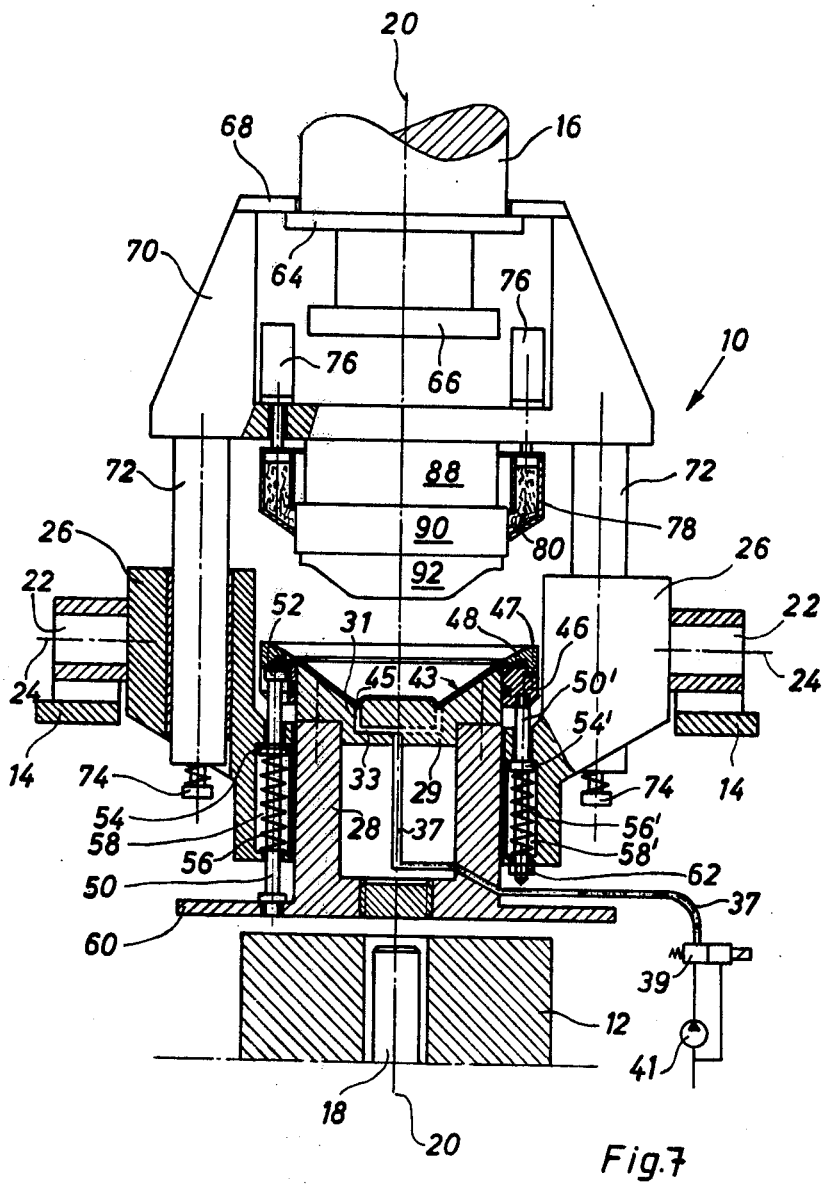
FIG. 7 is a view corresponding to FIG. 1 of a second embodiment of a press tool according to the invention.

The press tool shown in FIG. 7 differs from that shown in FIG. 1 to 6 mainly by the following characteristics:

The lower mould face 29 is a single unit. Its upper side is always essentially complementary to the underside of the plates which are to be made and in a region, corresponding to the foot of the plate, it has a chamber 31 for a pressure agent in the form of a groove with a cross section somewhat larger than that of the foot of the plate. The chamber 31 for the pressure agent is connected through several ducts 33 which, in the example shown, are first parallel to the axis and then radial and a collecting pipe 37 to valve 39 for selection of connection to the pressure—or suction side of a pump 41. The pump 41 delivers a pressure agent which is essentially incompressible.

In the rest position as shown in FIG. 7, a membrane 43 is held against the upper side of the lower mould face 29 by suction produced by the pump in the chamber 31 for pressure agent. The membrane 43 consists of an elastomer which is resistant to the pressure agent, and in its relaxed condition it is essentially flat but it has a circular groove 45, corresponding to the foot of the plates, to be made, and under the influence of sub-atmospheric pressure the membrane protrudes into the annular chamber 31 for pressure agent, but does not completely fill it, as shown in FIG. 7. As in the embodiment shown in FIG. 1 to 6, a ring-shaped matrix shell 46 is guided by the cylindrical outside of the lower mould face 29. The membrane 43 is clamped between the matrix shell 46 and a clamping ring 47 which is screwed to the matrix shell. The clamping ring 47 has a funnel-shaped chamfer 48 on its upper side.

In every production cycle of the press tool 10, shown in FIG. 7, the initial downward movement of the upper tool part 70 filling of the mould and subsequent further downward movement of the upper tool part takes place in the same way as in the embodiment shown in FIGS. 1 to 6. As soon as the position is reached in which base plate 60 of the lower tool part 28 is resting on the press table 12 as shown in FIG. 5, the pump 41 feeds pressure agent into the chamber 31. From there the pressure agent finds its way into a volume between the lower mould face 29 and the membrane 43 extending to the matrix shell 46, so that the plate T being produced receives a uniform after compression on its whole underside.

In the embodiment shown in FIG. 7 the lower mould face 29 may consist of a porous material, preferably of a known plastic with embedded mineral particles. In this case ducts 33 are not required, and the collecting pipe is needed only from the pump 41 through the valve 37 to the interior of the lower tool part 28 which is closed as shown. From here and through the porous lower mould faces 29 the whole underside of the membrane 43 can be exposed to the desired pressure, i.e. to sub-atmospheric pressure, when the membrane is to be held in its rest position as shown in FIG. 7, or to an increased pressure of the pressurizing agent, when the membrane is to be pressed upwards for re-compression of the ceramic material.

I claim:

1. A press tool for production of moulded ceramic articles such as plates, from powder material, including a lower tool part adapted to be supported on a press table and carrying a lower die, a matrix shell encircling the lower die and mounted to move up and down relatively to it, and a press plunger with an upper tool part connected thereon and carrying an upper die which on lowering of the plunger projects into the matrix shell, and, to fill the powder material into a cavity defined by the lower die and the matrix shell, an annular hopper in the form of a funnel encircling and mounted to slide axially on the upper die, the hopper having an annular outlet facing radially inwards and opening into the cavity when the hopper is in its lower position with respect to the upper die but closed by the upper die when the hopper is in a raised position relatively to the upper die.

2. A press tool as claimed in claim 1, in which a cylindrical collar with a diameter slightly larger than the inside diameter of the matrix shell is formed on the upper die for guidance and closing of the annular hopper.

3. A press tool as claimed in claim 1 or claim 2 in which the matrix shell has a funnel shaped chamfer corresponding to the similarly funnel-shaped lower end of the annular hopper.

4. A press tool as claimed in any one of the preceding claims in which the annular hopper together with the lower die, matrix shell and upper die can be tilted about a tilting axis extending transversely to the axis of the mould.

5. A press tool as claimed in claim 4 in which the tilting axis is horizontal and is outside of the plane of the axis of the mould.

6. A press tool as claimed in claim 4 or claim 5, in which the horizontal axis is defined by trunnions on a frame in which the lower and upper parts of the tool which are guided to move relatively to one another in the direction of the axis of the mould, the lower part of the tool being supported by springs.

7. A press tool as defined in claim 1 wherein the lower die includes a radially outer mould ring, a radially inner mould plate and also an intermediate mould ring, said outer mould ring having a contour corresponding at least to a radially outer part of the underside of a rim portion of the plate, said intermediate mould ring being complementary to a foot of the plate and to the radially inner part of the rim of the plate, the intermediate mould ring being adjustable relatively to the outer mould ring along the axis of the mould, and said radially inner mould plate also being rigidly connected to the outer mould ring.

8. A press tool as claimed in claim 7, in which the outer mould ring is supported on top of the lower part of the tool into which a threaded stop ring is screwed to serve as adjustable support for the intermediate mould ring, with a plug extending downwards from the central mould ring through the threaded stop ring for operation by a lifting mechanism of the press.

9. A press tool as claimed in claim 8 in which the lower part of the tool is supported on the frame of the tool by means of springs which, in an unloaded condition, hold it at a distance above the press table.

10. A press tool as claimed in any one of the preceeding claims in which a membrane, clamped at its outer edge, closes a chamber for a pressurizing agent in the lower die, the greater part of the area of the membrane, in the state for filling, being held against the lower die but being able to be pressed upwards by means of a pressurizing agent which is fed into the chamber for the pressurizing agent to further compress the powdery material.

11. A press tool as claimed in claim 10, in which the membrane is held against the lower die by its own elasticity as long as the pressure in the chamber for the pressurizing agent is the same as the ambient pressure.

12. A pressure tool as claimed in claim 10, in which the membrane by itself is essentially flat, but in the state for filling is held against the lower die by suction in the chamber for pressurizing agent.

13. A press tool as claimed in any one of claims 10 to 12 in which the face of the lower die consists of a porous material.

14. A press tool as claimed in claim 13, in which the face of the lower die consists of a porous plastic with embedded mineral particles.

* * * * *